US007393268B2

(12) United States Patent
Schrottner

(10) Patent No.: US 7,393,268 B2
(45) Date of Patent: Jul. 1, 2008

(54) RING SYSTEM FOR GUIDING A MEDIUM IN AN ABRASIVE DISK

(76) Inventor: Gerhard Schrottner, Kleingaisfeld 163, A-8564 Krottendorf-Galsfeld (AT)

( * ) Notice: Subject to any disclaimer, the term of this patent is extended or adjusted under 35 U.S.C. 154(b) by 0 days.

(21) Appl. No.: 10/570,375

(22) PCT Filed: Sep. 6, 2004

(86) PCT No.: PCT/EP2004/009897

§ 371 (c)(1),
(2), (4) Date: Feb. 15, 2007

(87) PCT Pub. No.: WO2005/023490

PCT Pub. Date: Mar. 17, 2005

(65) Prior Publication Data

US 2007/0259610 A1 Nov. 8, 2007

(30) Foreign Application Priority Data

Sep. 4, 2003 (AT) ..... A 1388/2003

(51) Int. Cl.
*B24B 55/02* (2006.01)

(52) U.S. Cl. ..... 451/449; 451/450; 451/541

(58) Field of Classification Search ..... 451/449, 451/450, 541

See application file for complete search history.

(56) References Cited

U.S. PATENT DOCUMENTS

| | | | | | |
|---|---|---|---|---|---|
| 3,110,993 | A * | 11/1963 | Grage | 451/450 |
| 4,622,780 | A * | 11/1986 | Tingley | 451/41 |
| 5,129,190 | A * | 7/1992 | Kovach et al. | 451/53 |
| 5,846,125 | A * | 12/1998 | Robichon | 451/450 |
| 5,993,297 | A * | 11/1999 | Hyatt et al. | 451/53 |
| 7,052,379 | B2 * | 5/2006 | Burgess | 451/231 |
| 7,094,136 | B2 * | 8/2006 | Nomoto et al. | 451/178 |
| 2003/0032382 | A1 * | 2/2003 | Suzuki et al. | 451/450 |

* cited by examiner

*Primary Examiner*—Eileen P. Morgan
(74) *Attorney, Agent, or Firm*—Andrew Wilford

(57) ABSTRACT

The invention relates to a ring system for accommodating a medium, to a method for compressing and guiding a medium for use in any known grinding methods for abrasive disks that consist of a support (1) and an abrasive lining (2) disposed on the circumference or face thereof for use on the circumference or the face of a work piece. The ring system provides a cavity and guide system for the coolant and lubricant. In said system the medium is accommodated, compressed and guided to the desired location of use. Optionally, the medium can be transported between the work piece and the abrasive lining (2) and/or to the interior or exterior of the abrasive disk to the desired location of use for the purpose of cooling, lubrication and cleaning.

6 Claims, 8 Drawing Sheets

Figur 1
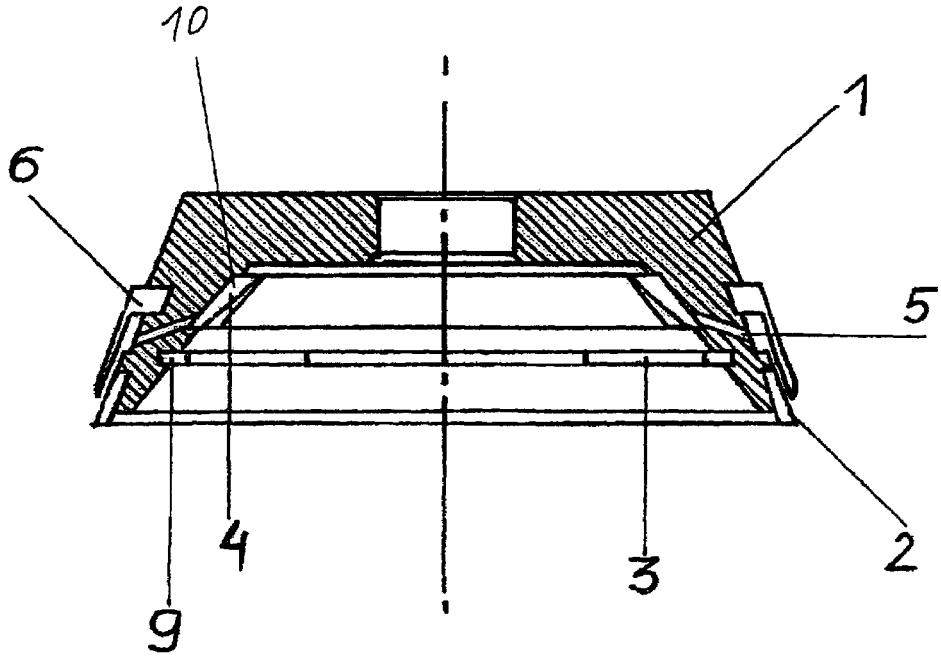

Figur 2
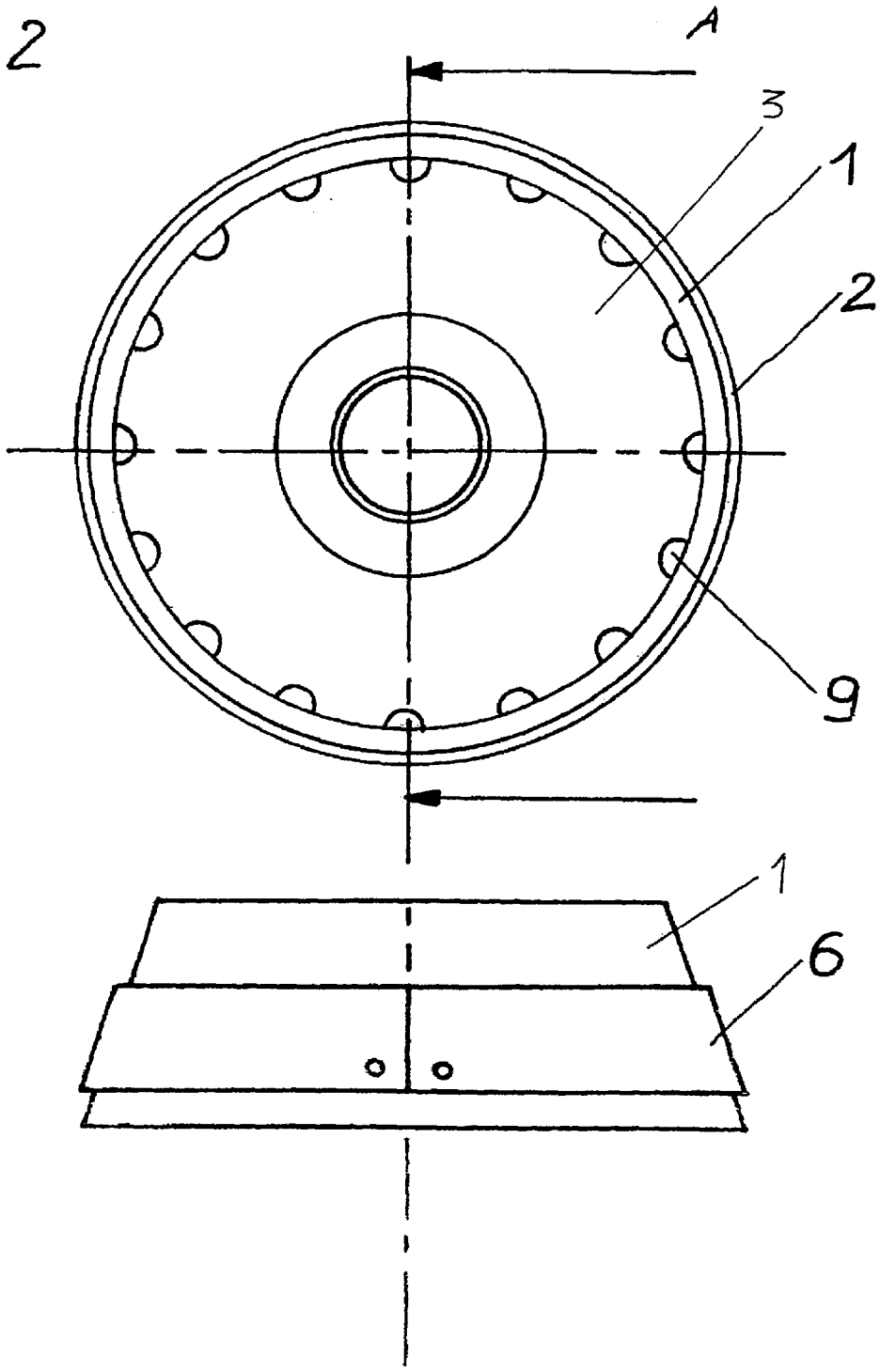

Figur 3
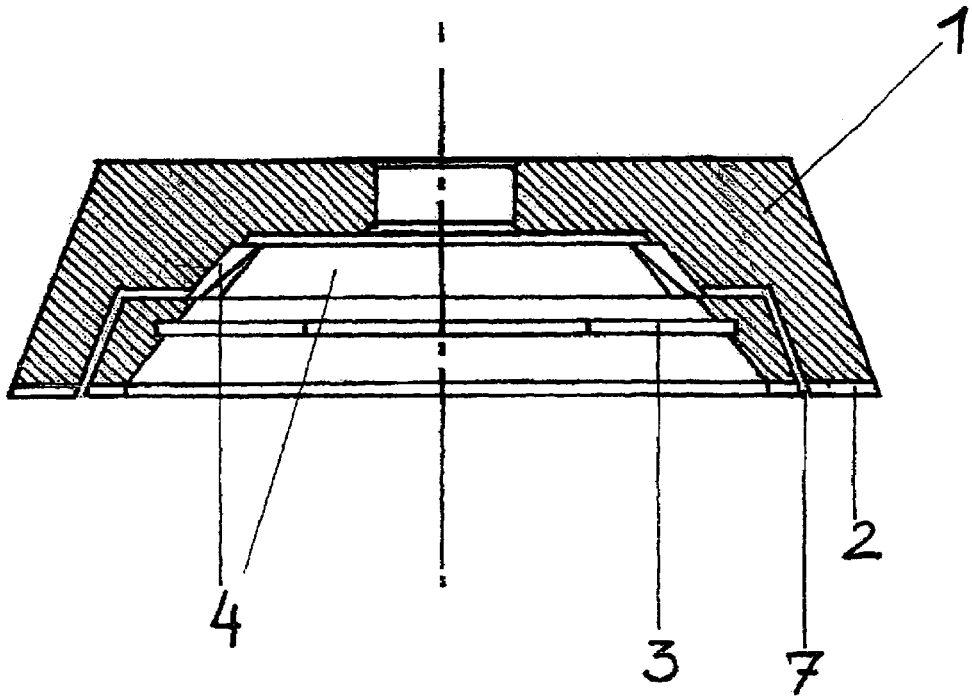

Figur 4
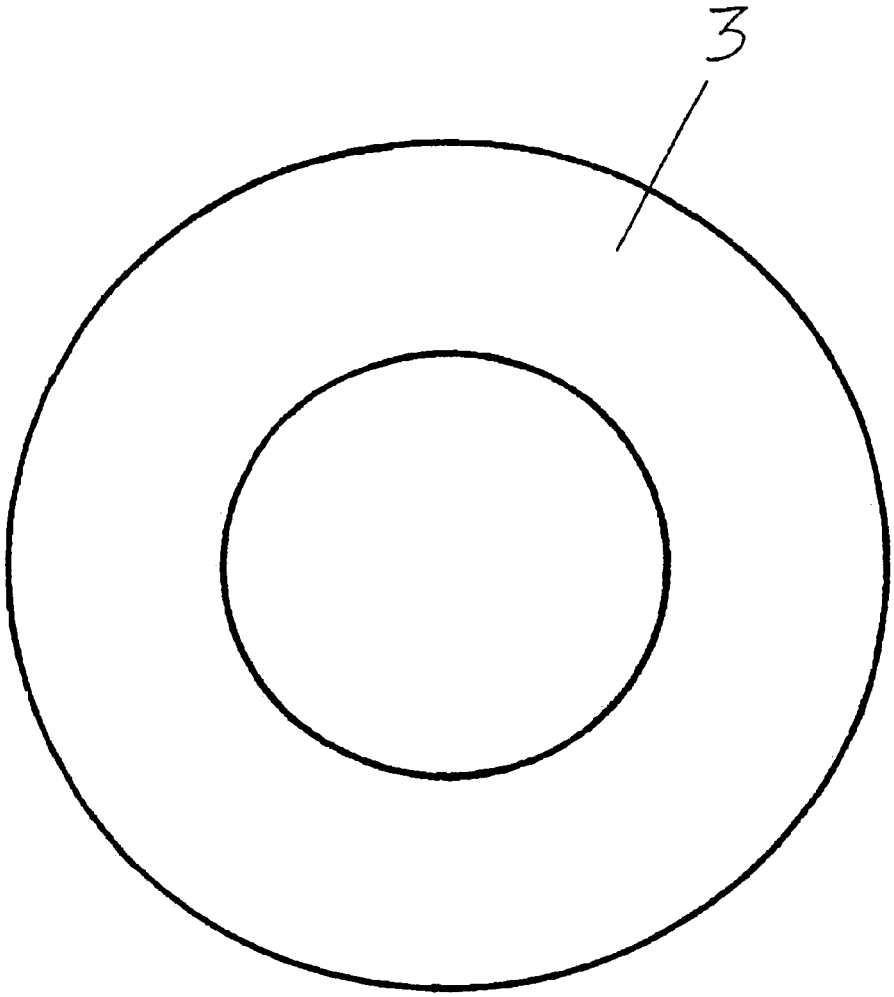

Figur 5
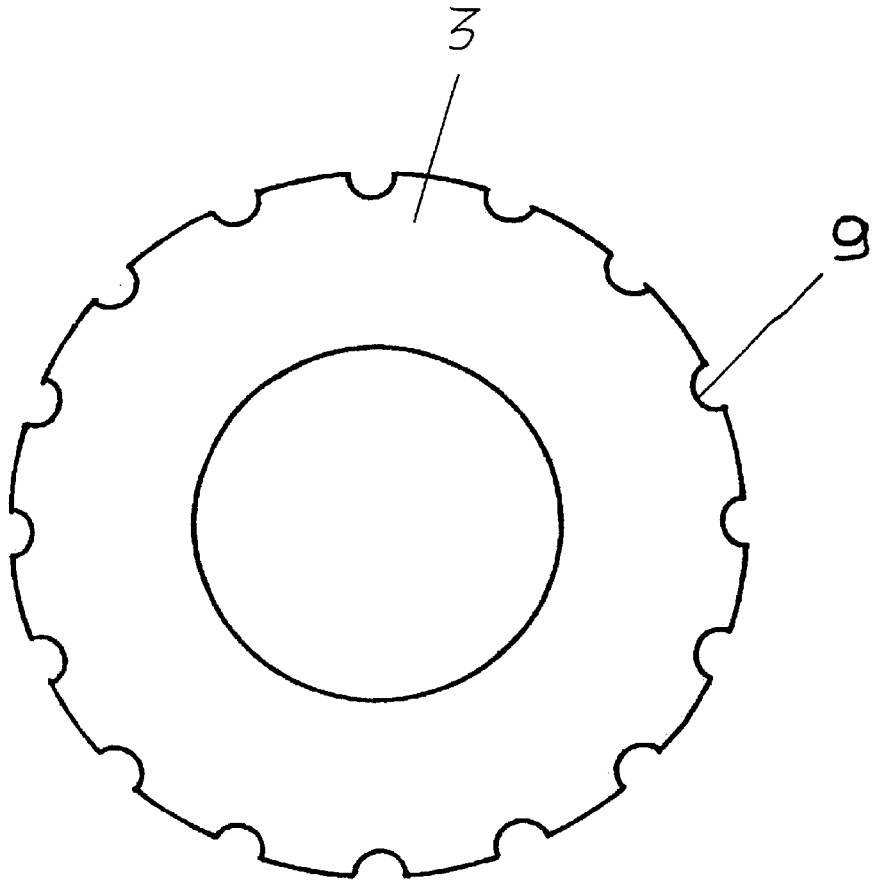

Figur 6
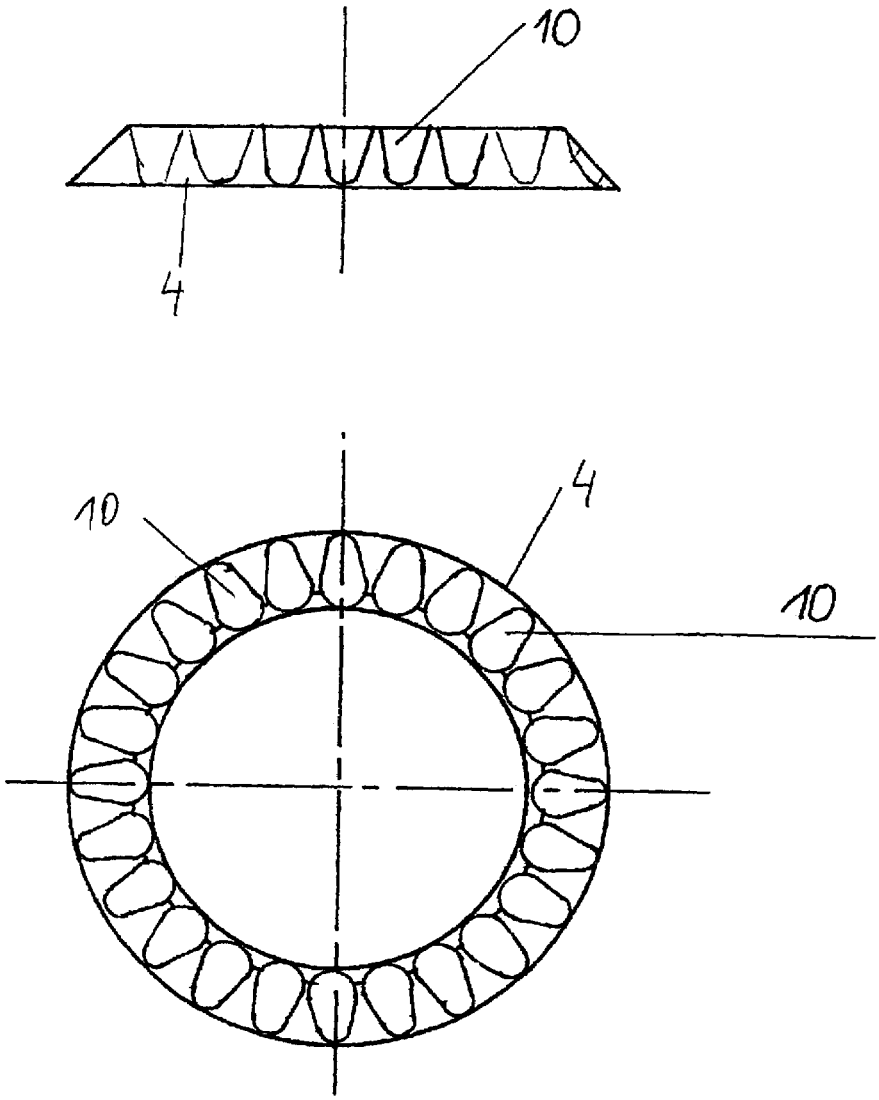

Figur 7
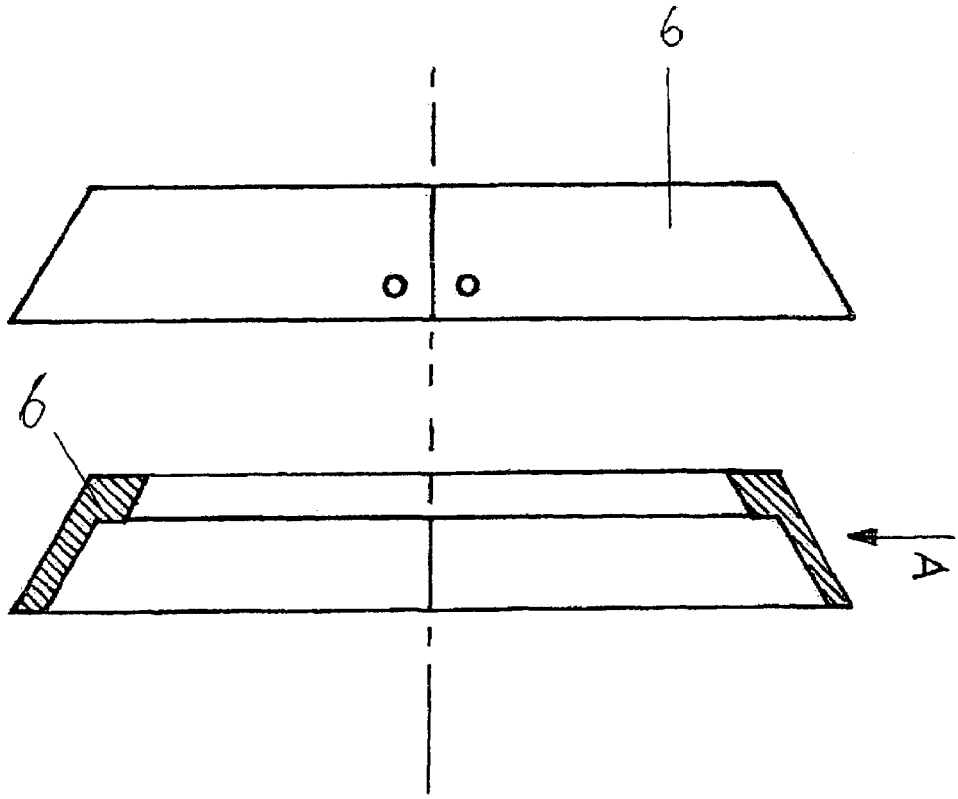

Figur 8
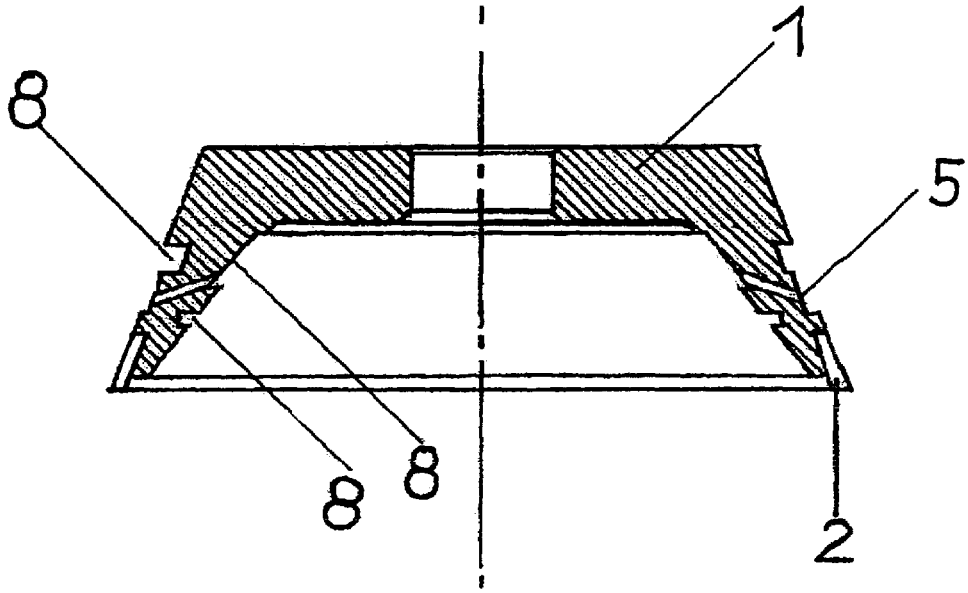

RING SYSTEM FOR GUIDING A MEDIUM IN AN ABRASIVE DISK

CROSS REFERENCE TO THE RELATED APPLICATIONS

This application is the US national phase of PCT application PCT/EP2004/009897, filed 6 Sep. 2004, published 17 Mar. 2006 as WO 2005/023490, and claiming the priority of Austrian patent application A1388/2003 itself filed 4 Sep. 2003.

FIELD OF THE INVENTION

The invention relates a ring assembly for grinding wheels for feeding a treatment fluid for all known grinding procedures and grinding wheels consisting of a body, a grinding layer provided on an outer or end face for edge or face grinding. When a workpiece, independent of its structure and of its grinding layer, is subjected to a grinding procedure there are high temperatures in the work area of the grinding tool that can be controlled by means of a cooling and lubricating fluid.

OBJECT OF THE INVENTION

It is the object of the invention to improve the cooling and lubrication, even of grinding wheels already in use without large modification efforts.

SUMMARY OF THE INVENTION

This is achieved by the fact that the cooling and lubricating treatment fluid is received, pressurized and fed to the necessary points of application in the grinding operation by a ring assembly mounted on the grinding wheel. With this system for conveying lubrication and coolant, the treatment fluid can be transported more directly to the designated points of application. Additionally, the grinding body is cooled more constantly and more strongly. This results in better grinding performances and improved quality at the workpiece as well as in increased grinding tool life.

The ring for holding the treatment fluid can be composed of many different materials and can be made by many different processing and machining procedures (e.g. machining, metal shaping, casting). This fluid-holding ring with its central opening serves to create a hollow chamber and thus feeds the treatment-fluid into the inner body of the grinding wheel. The fluid-holding ring can be made of one or more parts and is connected and fixed to the grinding body by means of a groove formed in the grinding body. Optionally, the fluid-holding ring can have bores which transport the cooling and lubricating treatment fluid in concentrated form to the designated point of application at the inner side of the grinding wheel.

The ring for feeding and pressurizing the treatment fluid can be composed of many different materials and made by many different processing and machining procedures (e.g. machining, metal shaping, casting). The feeding/pressurizing ring can be made of one or more parts and is connected and fixed to the grinding body by means of a groove formed in the grinding body. This ring is also mounted on an inner side of the grinding body and with its recesses serves for pressurizing the treatment fluid. Thus, the cooling and lubricating liquid is forced to assume the circumferential speed of the grinding wheel. The pressurized treatment fluid is either transported through bores in the grinding body to an outer edge of the grinding wheel to the ring for controlling the liquid discharge and is thus transported to the point of application, or it is moved through bores in the grinding body and its abrasive layer directly to the point of application.

The ring controlling treatment-fluid discharge can be composed of many different materials and made by many different processing and machining procedures (e.g. machining, metal shaping, casting). The ring for controlling treatment-fluid discharge can be made of one or more parts and is connected and fixed to the grinding body by means of a groove arranged in the grinding body. With this ring the pressurized treatment fluid is fed to the outer edge of the grinding wheel to the desired point of application.

By means of the invention, the known and already used grinding wheels can be improved without significant modification when manufacture or retrofitted, particularly with respect to improved grinding characteristics, longer service life, less machine downtime, less machining time, improved repeating exactness and reduced heating of the grinding wheel and the workpiece as well as improved surface quality of the workpiece. Thanks to the improved lubricating and cooling effect there are no crystalline modifications of the processed materials.

BRIEF DESCRIPTION OF THE DRAWING

The drawing shows an embodiment of the object of the invention.

FIG. 1 shows a section through a 11V9 grinding wheel according to the line A of FIG. 2;

FIG. 2 shows a view of the 11V9 grinding wheel;

FIG. 3 shows a variation of the bore extending through the body and the grinding layer to the point of application;

FIG. 4 shows a view of the ring for holding the treatment fluid;

FIG. 5 shows a view of the ring for holding the treatment fluid with discharge openings for controlling treatment-fluid discharge;

FIG. 6 shows a view of the ring for feeding and pressurizing the treatment fluid;

FIG. 7 shows a view of the ring for controlling treatment-fluid discharge;

FIG. 8 shows a view of the body with prefabricated grooves without an installed ring assembly.

SPECIFIC DESCRIPTION

The grinding wheel consists of a body 1 and a grinding layer 2 with a mounted fluid-holding ring 3 through a central opening of which a treatment fluid is fed to the grinding wheel. A ring 4 for feeding and pressurizing the treatment fluid feeds this cooling and lubricating treatment fluid either by means of connecting bores 5 to a ring 6 for controlling treatment-fluid discharge or through discharge bores 7 in the body and grinding layer. According to the design of the grinding wheel and according to requirements, the treatment fluid can also be fed through discharge openings 9 to a grinding point at an inner edge of the grinding wheel. All the rings of the system are anchored in preformed grooves 8. Due to the centrifugal force of the turning grinding wheel, the treatment fluid is pressurized and transported through the passages, cutouts or partitions 10 in the feeding/pressurizing ring in concentrated form to the contact area at the grinding layer and workpiece.

The invention claimed is:

1. A grinding assembly comprising:

a wheel centered on and rotatable about an axis and formed by annular base body and having an axially or radially directed face and formed with a plurality of angularly arrayed discharge bores opening outwardly at or adjacent the face and inwardly inside the base body, and a grinding layer of material on the face of the base body;

an outer ring set in the base body and having an axially open central hole adapted to receive lubricant/coolant treatment liquid and forming with the base body a liquid-holding cavity; and an inner ring fixed in the base body in the cavity and provided with formations communicating with the inner ends of the bores that conduct fluid the treatment liquid from the cavity to the bores and that are shaped to pressurize the liquid on rotation of the wheel.

2. The grinding assembly according to claim 1, further comprising at least one further ring radially outside the layer serves for controlling treatment-fluid after discharge from the outer ends of the bores.

3. The grinding assembly according to claim 1, further comprising treatment-fluid nozzles and tubes opening into the central hole and feeding the liquid into the cavity.

4. The grinding assembly according to claim 3, further comprising a machine spindle carrying the base body, the nozzles and tube being radially adjacent the spindle.

5. The grinding assembly according to claim 1 wherein the discharge bores extend generally radially through the body and the grinding layer for discharge of the treatment fluid at a contact area between the grinding layer and the workpiece.

6. The grinding assembly defined in claim 1 wherein the base body is formed internally with axially offset inner and outer grooves into which the inner and outer rings are set.

* * * * *